US006115982A

United States Patent [19]

Lindenberg

[11] Patent Number: 6,115,982

[45] Date of Patent: Sep. 12, 2000

[54] MOUNTING/TRIM STRIPS FOR WALL, CEILING, OR FLOOR PANELS

[75] Inventor: Klaus Lindenberg, Essen, Germany

[73] Assignee: W. Dollken & Co. GmbH, Essen, Germany

[21] Appl. No.: 09/149,963

[22] Filed: Sep. 9, 1998

[30] Foreign Application Priority Data

Sep. 9, 1997 [DE] Germany ..... 297 16 146 U

[51] Int. Cl.[7] ..... E04B 2/00

[52] U.S. Cl. ..... 52/506.05; 52/287.1; 52/288.1; 52/272; 52/461; 52/463; 52/718.04

[58] Field of Search ..... 52/287.1, 288.1, 52/272, 461, 463, 204.53, 204.54, 35, 718.04, 506.05

[56] References Cited

U.S. PATENT DOCUMENTS

| | | | |
|---|---|---|---|
| 3,007,213 | 11/1961 | Hobbs | 52/287.1 |
| 3,638,374 | 2/1972 | Hardy | 52/287.1 |
| 3,667,177 | 6/1972 | Biela | 52/288.1 |
| 4,385,850 | 5/1983 | Bobath | 52/461 |
| 5,079,880 | 1/1992 | Reid | 52/288.1 |
| 5,181,357 | 1/1993 | Pourtau et al. | 52/287.1 |
| 5,713,159 | 2/1998 | Schmidt | 52/204.53 |
| 5,829,206 | 11/1998 | Bachman | 52/287.1 |
| 5,836,113 | 11/1998 | Bachman | 52/287.1 |

FOREIGN PATENT DOCUMENTS

| | | | |
|---|---|---|---|
| 461761 | 10/1968 | Switzerland | 52/204.53 |

*Primary Examiner*—Robert Canfield
*Assistant Examiner*—Dennis L. Dorsey
*Attorney, Agent, or Firm*—Herbert Dubno; Andrew Wilford

[57] ABSTRACT

An assembly for mounting a panel at a corner between a pair of generally perpendicular wall surfaces has a mounting strip extending longitudinally along the corner, having a seat engaging an edge of the panel, retaining the panel edge against one of the surfaces, and formed with a longitudinally extending and transversely open slot. A trim strip extends longitudinally along the corner in engagement with the panel and the other wall surface and is formed with a longitudinally extending and transversely projecting lip engaged tightly in the slot.

4 Claims, 3 Drawing Sheets

MOUNTING/TRIM STRIPS FOR WALL, CEILING, OR FLOOR PANELS

FIELD OF THE INVENTION

The present invention relates to a mounting and trim assembly for wall, ceiling, or floor panels. More particularly this invention concerns trim strips adapted for securing such panels to the floor, ceiling, or wall.

BACKGROUND OF THE INVENTION

It is standard to mount panels such as ceiling tiles, wall paneling, or floor carpeting or tile by means of a mounting strip and a trim strip. The mounting strip has a seat, typically U-shaped, that receives the edge of the panel and this strip is secured solidly to the support surface, typically by nailing, screwing, or gluing. Then the decorative trim strip is mounted over the mounting strip to dress it up and conceal any poor fit of the strip in the corner.

Thus the installer must laboriously install two separate elements. After going completely around the edge of the ceiling, wall, or floor with the mounting strips and securing the panels in place, he or she must then go completely around again, installing the trim strips. This therefore entails two completely independent operations, typically of nailing and can even involve having to drill two separate sets of holes. Furthermore getting the trim strip to fit tightly is often difficult, and it is virtually impossible to remove and reinstall one of the trim strips since such a trim strip cannot be removed without damaging it so if renovations must be done, new trim strips must be supplied.

OBJECTS OF THE INVENTION

It is therefore an object of the present invention to provide an improved trim/mounting assembly for a wall, floor, or ceiling panel.

Another object is the provision of such an improved trim/mounting assembly for a wall, floor, or ceiling panel which overcomes the above-given disadvantages, that is which is relatively easy to install and which can be removed and reinstalled without damage.

SUMMARY OF THE INVENTION

An assembly for mounting a panel at a corner between a pair of generally perpendicular wall surfaces has according to the invention a mounting strip extending longitudinally along the corner, having a seat engaging an edge of the panel, retaining the panel edge against one of the surfaces, and formed with a longitudinally extending and transversely open slot. A trim strip extends longitudinally along the corner in engagement with the panel and the other wall surface and is formed with a longitudinally extending and transversely projecting lip engaged tightly in the slot.

Thus once the panel or panels are secured in place by the mounting strip, the trim strip is simple snapped into place by fitting its lip to the mounting-strip groove. The tight fit ensures that the trim strip will be solidly retained in contact with both wall surfaces. No tools are needed to make the connection with the new trim strip, merely cutting or mitering at the ends.

The mounting strip according to the invention is basically U-shaped and has a pair of generally parallel lips forming the seat. These lips can diverge to ensure a very solid and tight fit of the panel in the seat. The slot can be open parallel to the one surface and the trim-strip lip can extend parallel to the one surface or the slot can be open parallel to the other surface with the trim-strip lip parallel to the other surface.

In another system according to the invention the trim strip is formed with a transversely open groove and includes an L-shaped connector strip having one leg forming the trim-strip lip and another leg seated in the trim-strip groove. In this case the trim strip can be solid, that is not hollow.

The mounting strip according to the invention can have a back flange extending parallel to the other surface and a pair of parallel and spaced lips overlying the panel and forming the slot. The lip and slot can each be formed with interengaging longitudinally extending ridges. For tightest possible fit of the lip in the slot, the slot is formed by a pair of outwardly diverging lips. Furthermore the trim strip can be formed with a recess engaged over the panel edge.

Another assembly for mounting a panel at a corner between a pair of generally perpendicular wall surfaces has according to the invention an L-shaped mounting strip extending longitudinally along the corner, having a leg engaged in a slot at an edge of the panel, and having another leg. Here the trim strip extends longitudinally along the corner in engagement with the panel and the other wall surface and is formed with a longitudinally extending and transversely open slot in which the other leg of the mounting strip is engaged. In this arrangement the trim strip can be formed with a longitudinally extending seat complementarily engaging the panel edge.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
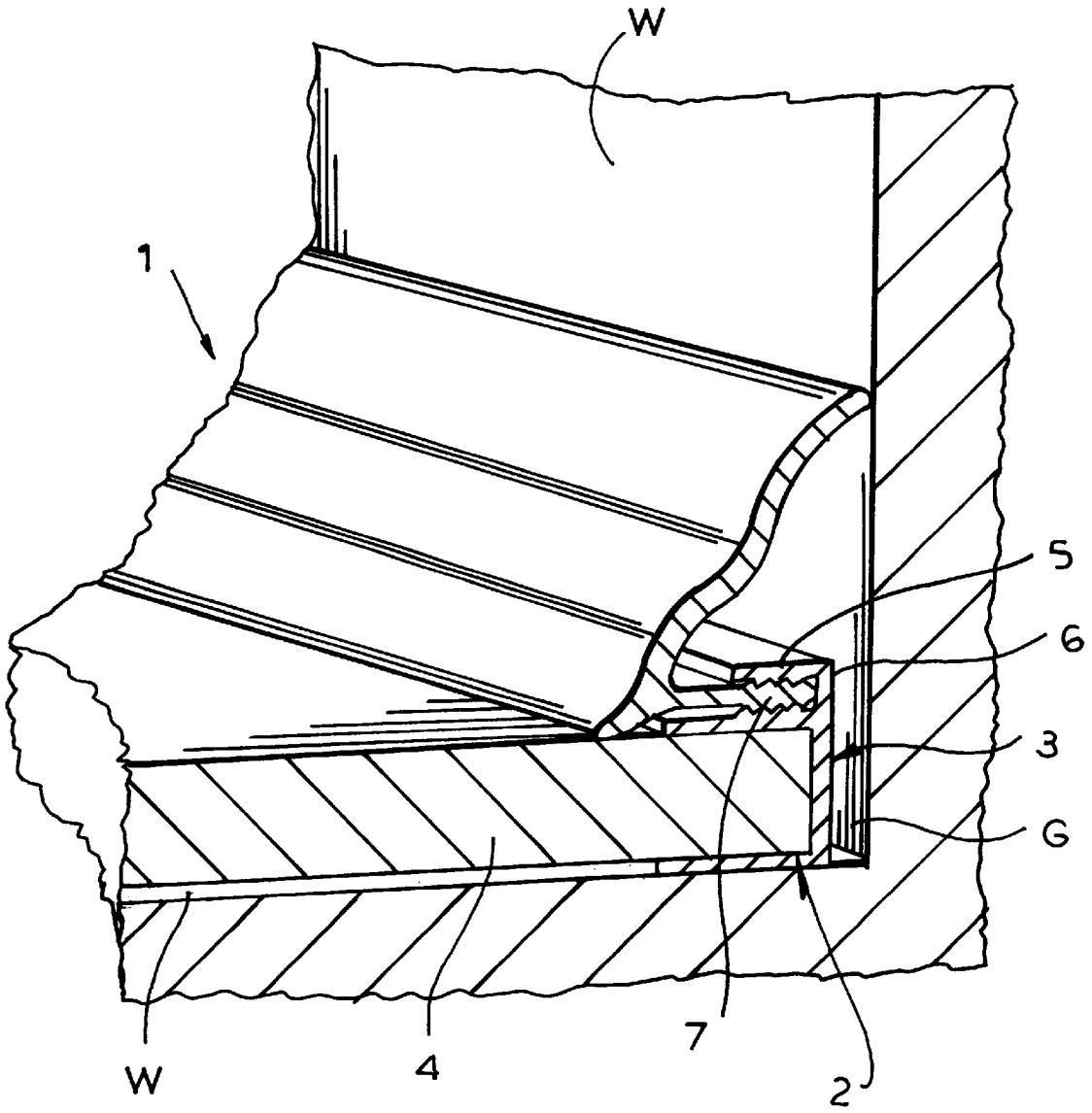
FIG. 1 is a sectional perspective view of a first embodiment of the system of this invention.
Figure 2:
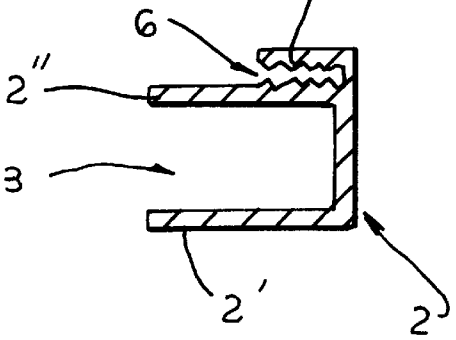
FIGS. 2 and 3 are cross sections through the mounting and trim strips of the system of FIG. 1.
Figure 3:
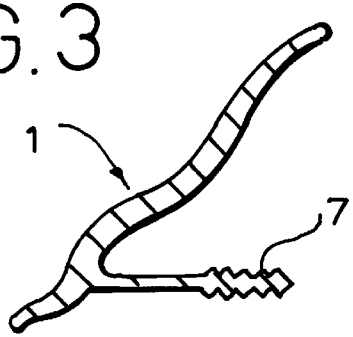

As seen in FIGS. 1 through 3, a trim/mounting assembly according to the invention basically comprises a trim strip 1 and a mounting strip 2, both made of extruded metal or plastic, used to secure a panel 4 at a corner defined between a pair of perpendicular and planar wall surfaces W. The mounting strip 2 has a pair of legs or flanges 2' and 2" shown in FIG. 2 defining a U-shaped seat 3 into which an edge of the panel 4 is fitted and in which it is retained. Unillustrated fasteners or glue secure the strip 2 to one or both of the wall surfaces W. In addition this strip 2 has a third lip or flange 5 defining a narrow transversely open and longitudinally extending slot 6 internally formed with longitudinally extending ridges. The trim strip 1 as best shown in FIG. 3 is mainly formed smooth with a wavy-contoured surface and is provided with a longitudinally extending tongue 7 formed with longitudinally extending ridges and extending at an angle of about 45° to the body of the strip 1. The sides of the seat 3 and slot 6 can both diverge for tightest possible fit.

To mount the panel 4 in place the mounting strip 2 is typically secured in the corner between the wall surfaces W and then the panel edge is slid into it, although it is of course possible to fit the strip 2 over the panel edge and then mount this subassembly to the one or other wall surface W. As shown there is often a gap G between the mounting strip 2 and one of the wall surfaces W. Then according to the invention the lip 7 of the trim strip 1 is simply pressed into the slot 6, with the interengaging ridges forming a tight force fit between the strips 1 and 2. The trim strip 1 is somewhat resilient, so that it will snugly engage the outer face of the panel 4 and the adjacent wall surface W, completely covering the mounting strip 2 and forming a neat finished appearance.

Figure 4:
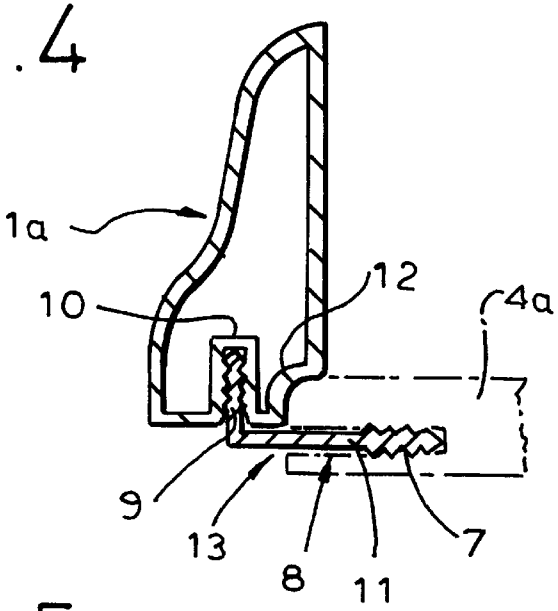
FIG. 4 is a cross section through a second embodiment of the system.
Figure 5:
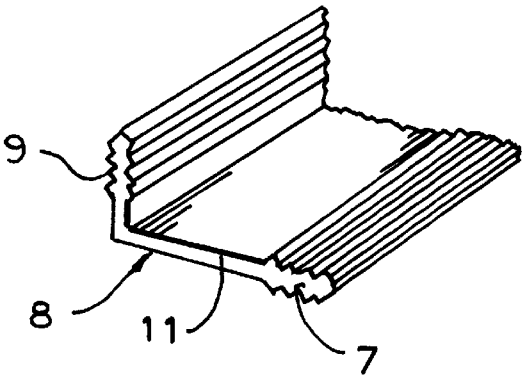
FIG. 5 is perspective view of the connecting strip of the FIG. 4 embodiment.

In the arrangement of FIGS. 4 and 5 a trim strip 1*a* is formed with a downwardly open and internally ridged slot 10 in which is engaged a vertical leg 9 of an L-shaped connector strip 8 having another leg 11 whose outer end is formed as the lip 7 engaged in a seat 13 of a panel 4*a*. Here the strip 1*a* is formed with a groove or seat 12 that accommodates an edge of the panel 4*a*.

Figure 6:
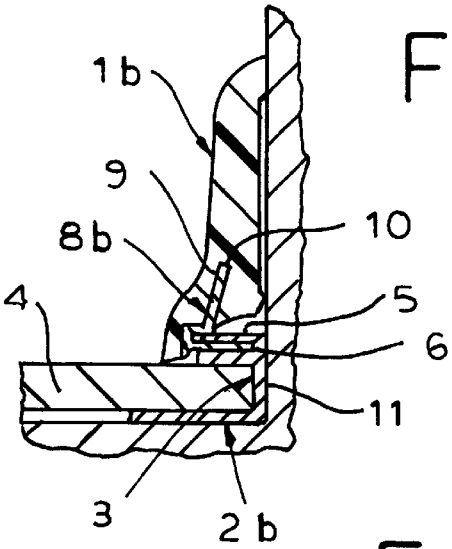
FIG. 6 is a cross section through a third embodiment of the system according to the invention.

In the arrangement of FIG. 6 the strip 2*b* is substantially identical to that of FIGS. 1 through 3, but here the trim strip 1*b* is solid and has a connector strip 8*b* similar to that of FIGS. 4 and 5 set in it, that is there are three strips 1*b*, 2*b*, and 8*b*.

Figure 7:
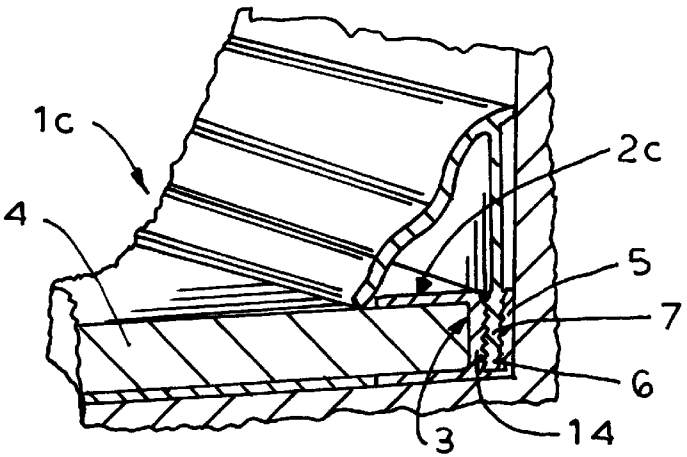

In FIG. 7 the strip 1*c* has a connecting lip 1*c* that is vertical and the mounting strip 2*c* is formed with an upwardly open slot 6 defined between the lip 5 and a rear wall 14 of the seat 3.

Figure 8:
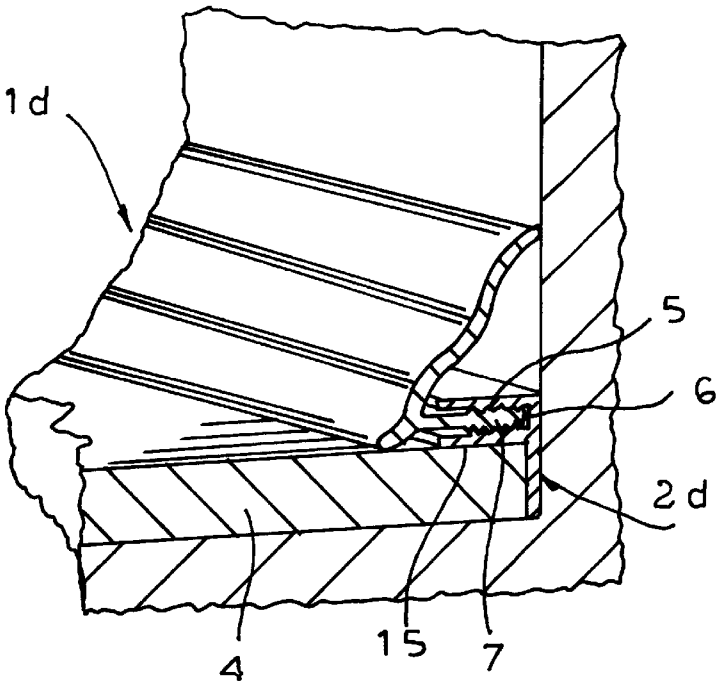
FIGS. 7 and 8 are sectional perspective views of fourth and fifth embodiments of the invention.

The system of FIG. 8 has a trim strip 1*d* identical to that of FIG. 1, but here a mounting strip 2*d* is provided which is lacking the lip 2'. A mastic or glue strip 15 is used to secure this strip 2*d* in place atop the panel 4.

I claim:

1. An assembly mounting a panel at a corner between a pair of generally perpendicular wall surfaces, the assembly comprising:

a basically U-shaped mounting strip extending longitudinally along the corner, having a pair of generally parallel transversely protecting legs forming a transversely open seat engaging around an edge of the panel and retaining the panel edge against one of the surfaces with one of the legs lying against the one surface, the other lea being spaced from the one surface and forming a longitudinally extending slot open transversely parallel to the seat; and a trim strip extending longitudinally along the corner in engagement with the panel and with the other wall surface and formed with a longitudinally extending and transversely projecting lip engaged tightly in the slot.

2. The mounting assembly defined in claim 1 wherein the slot is open parallel to the one surface and the trim-strip lip is parallel to the one surface.

3. The mounting assembly defined in claim 1 wherein the mounting strip has a back flange extending parallel to the other surface and a pair of parallel and spaced lips overlying the panel and forming the slot.

4. The mounting assembly defined in claim 1 wherein the lip and slot are each formed with interengaging longitudinally extending ridges.

* * * * *